US006668508B2

(12) United States Patent
Boone et al.

(10) Patent No.: US 6,668,508 B2
(45) Date of Patent: Dec. 30, 2003

(54) SHEAR PANEL ASSEMBLY

(75) Inventors: Glyn Richard Boone, Leola, PA (US); Lionel L. Brightwell, Boise, ID (US); Miles E. Waltz, Jr., Boise, ID (US)

(73) Assignee: Weyerhaeuser Company, Federal Way, WA (US)

( * ) Notice: Subject to any disclaimer, the term of this patent is extended or adjusted under 35 U.S.C. 154(b) by 26 days.

(21) Appl. No.: 09/941,486

(22) Filed: Aug. 28, 2001

(65) Prior Publication Data

US 2003/0041551 A1 Mar. 6, 2003

(51) Int. Cl.[7] ..... E04C 2/38

(52) U.S. Cl. ..... 52/645; 52/656.1; 52/295; 52/800.12; 52/698

(58) Field of Search ..... 52/295, 296, 713, 52/715, 800.18, 800.1, 801.11, 645, 649.5, 653.1, 655.1, 656.1, 800.12, 656.2; 403/71, 119; 248/59, 351

(56) References Cited

U.S. PATENT DOCUMENTS

| | | | | |
|---|---|---|---|---|
| 967,107 A | | 8/1910 | Cook et al. | |
| 991,573 A | | 5/1911 | Wells | |
| 1,155,243 A | | 9/1915 | Jordahl | |
| 1,375,043 A | | 4/1921 | Finlayson | |
| 1,589,528 A | | 6/1926 | Hayes | |
| 1,922,479 A | | 8/1933 | Joslin | |
| 2,137,767 A | | 11/1938 | Betcone | |
| 2,625,815 A | | 1/1953 | Black | |
| 2,829,514 A | | 4/1958 | MacLean | |
| 2,909,816 A | | 10/1959 | Wood | |
| 3,125,190 A | | 3/1964 | Brennan | |
| 3,292,328 A | * | 12/1966 | Lewis et al. | 52/645 |
| 3,311,333 A | * | 3/1967 | Galloway | 52/210 |
| 3,411,252 A | | 11/1968 | Boyle | |
| 3,963,210 A | | 6/1976 | Macklin | |

(List continued on next page.)

FOREIGN PATENT DOCUMENTS

| | | |
|---|---|---|
| FR | 812785 | 12/1959 |
| JP | 63-83322 A | 4/1988 |
| NL | 6703671 | 10/1967 |

*Primary Examiner*—Carl D. Friedman
*Assistant Examiner*—Jennifer I. Thissell

(57) ABSTRACT

A shear panel assembly including a shear panel in combination with a shear panel hold-down. The shear panel includes a frame and a panel diaphragm including a peripheral edge. The frame includes an upper horizontal frame member pivotally interconnecting the upper ends of first and second upright frame members. A lower horizontal is connected at the lower ends of the first and second upright frame members. The peripheral edge of the panel diaphragm is secured to an inner periphery of the frame within the depth of the frame. The shear panel system includes a hold-down having a base and at least one upright frame member engagement tab pivotally connected to and extending from the base for attachment to an upright frame member.

7 Claims, 11 Drawing Sheets

U.S. PATENT DOCUMENTS

| | | | | | |
|---|---|---|---|---|---|
| 4,060,951 | A | | 12/1977 | Gere | |
| 4,192,118 | A | | 3/1980 | Gilb | |
| 4,199,908 | A | | 4/1980 | Teeters | |
| 4,321,776 | A | | 3/1982 | Delight | |
| 4,387,543 | A | | 6/1983 | Tschan et al. | |
| 4,458,463 | A | | 7/1984 | Behrend | |
| 4,530,194 | A | | 7/1985 | Linton et al. | |
| 4,612,848 | A | * | 9/1986 | Pollack | 98/50 |
| 4,614,070 | A | | 9/1986 | Idland | |
| 4,665,672 | A | | 5/1987 | Commins et al. | |
| 4,744,192 | A | | 5/1988 | Commins | |
| 4,783,945 | A | * | 11/1988 | Heeg | 52/656 |
| 4,884,376 | A | | 12/1989 | DeBlock et al. | |
| 4,924,648 | A | | 5/1990 | Gilb et al. | |
| 4,989,386 | A | | 2/1991 | Collis | |
| 4,995,206 | A | | 2/1991 | Colonias et al. | |
| 5,095,671 | A | * | 3/1992 | Mitani | 52/210 |
| 5,125,761 | A | | 6/1992 | Cullen et al. | |
| 5,307,603 | A | | 5/1994 | Chiodo | |
| 5,333,435 | A | | 8/1994 | Leek | |
| 5,375,384 | A | | 12/1994 | Wolfson | |
| 5,706,626 | A | | 1/1998 | Mueller | |
| 5,729,950 | A | | 3/1998 | Hardy | |
| 5,735,100 | A | * | 4/1998 | Campbell | 52/645 |
| 5,758,460 | A | * | 6/1998 | MacKarvich | 52/292 |
| 5,782,054 | A | | 7/1998 | Varoglu et al. | |
| 6,006,487 | A | | 12/1999 | Leek | |
| 6,050,035 | A | * | 4/2000 | Thompson et al. | 52/167.1 |
| 6,067,769 | A | | 5/2000 | Hardy | |
| 6,148,583 | A | | 11/2000 | Hardy | |

* cited by examiner

SHEAR PANEL ASSEMBLY

FIELD OF THE INVENTION

The present invention relates to a shear panel assembly for reducing the risk of damage to buildings as a result of lateral forces applied to the building.

BACKGROUND OF THE INVENTION

Typical building frame construction includes a frame anchored to the foundation and a roof assembly supported by the frame. The frame typically includes a plurality of vertically oriented studs attached between upper and lower plates. Inner and outer siding materials are attached to the frame. In a typical residential building, framing is accomplished by employing lumber and wood products.

Lateral forces applied to the wall, which may occur as a result of high winds or earthquakes, can cause the upper section of the wall to move relative to the lower section. This movement is commonly assumed to be in a direction parallel to and in the plane of the wall. Excess movement of the upper section of the wall relative to the anchored lower section can result in damage to the frame that may be catastrophic.

A variety of designs have been developed for resisting lateral forces. One method for providing lateral stiffening includes attaching a sheet material such as oriented strand board (OSB) or plywood to the frame exterior such that it spans across several studs and is attached to the upper and lower plates. A shear force applied to the wall in a direction parallel to and in the plane of the wall is therefore transmitted through the sheet material to a bottom plate and the foundation of the structure, thereby reducing the tendency of the upper portion of the wall to move relative to the lower portion of the wall. To enhance the strength of the shear panel, the bottom plate of the shear panel is typically fastened to the foundation by a plurality of anchor bolts or tiedowns to better resist shear forces.

Shear panels that incorporate a face-mounted shear membrane must include a reduced frame member depth in order to fit within the dimensions of common or standard framing elements. The resulting panels can exhibit reduced strength, reduced resistance to lateral forces and a reduced moment of inertia. In addition, shear panels that incorporate a face-mounted shear membrane are prone to warping and torque when lateral force is applied. In particular, the application of repetitive lateral motion, such as that experienced during cyclic shear testing of prefabricated shear panels, reveals that such face-mounted membranes tend to warp and twist, leading to failure of the shear panel. Even shear panels that incorporate the shear membrane in a sandwich structure exhibit failure upon repetitive lateral movement.

Also problematic, when such panels do fail, is that they tend to exhibit a brittle failure profile, that is, the panel provides resistance to lateral movement until a failure point is reached, at which point the shear panel fails rapidly and catastrophically, with the loss of a substantial amount of structural integrity.

What is needed is a shear panel assembly with improved performance to cyclic shear loading and improved ductility so that the panel will withstand greater cyclic lateral movement, and that upon failure, fail gradually rather than catastrophically.

SUMMARY OF THE INVENTION

The present invention is directed to a shear panel assembly that includes a frame and a panel diaphragm, where the frame comprises an upper horizontal frame member, a first upright, a second upright, and a lower horizontal frame member. The frame includes a panel diaphragm edge receiving member formed on an inner peripheral face of the frame, within a depth of the frame. The panel diaphragm includes a peripheral edge that is connected to the frame at the panel diaphragm edge receiving member.

Another form the invention takes includes a shear panel that includes a frame, where the frame comprises an upper horizontal frame member, a first upright that pivotally interconnects a first end of the upper horizontal frame member, a second upright that pivotally interconnects a second end of the upper horizontal frame member, a lower horizontal frame member that pivotally interconnects a lower end of the first upright and a lower end of the second upright, and a panel diaphragm that is connected to the frame.

Yet another aspect of the invention includes a shear panel hold-down that comprises a base and at least one pivotable upright engagement tab attached to and extending from the base.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

The advantages of the present invention will be understood more readily after a consideration of the drawings and the Detailed Description.

DETAILED DESCRIPTION AND BEST MODE OF THE INVENTION

Figure 1:
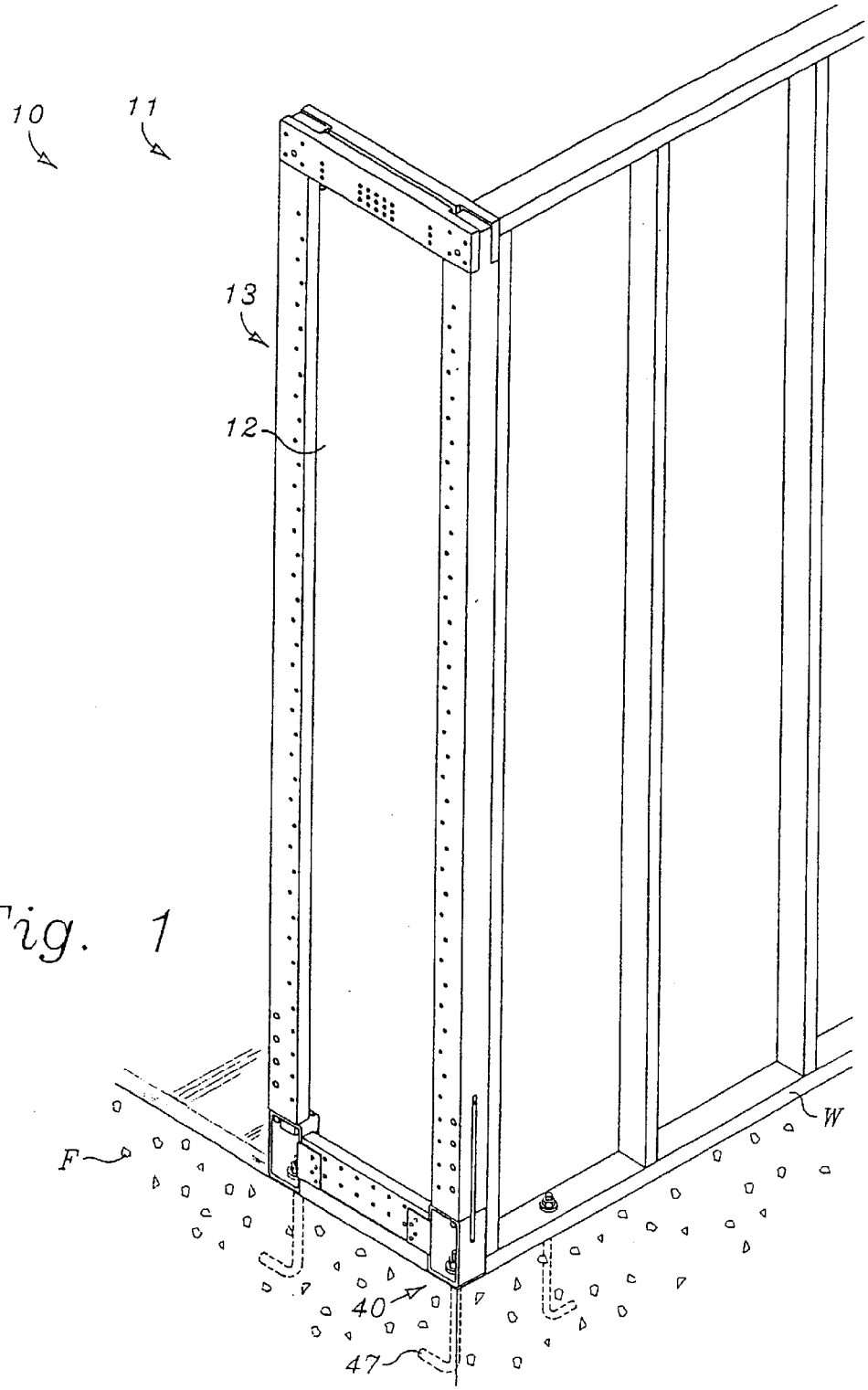
FIG. 1 is a representative assembled and installed perspective view of a shear panel assembly according to the present invention.

The present invention is directed to a shear panel assembly comprising a frame and a panel diaphragm connected to the frame. The shear panel assembly may include one or more shear panel hold-downs, or incorporate the panel diaphragm within an inner periphery of the frame. The shear panel frame includes first and second uprights, and upper and lower horizontal frame members that interconnect the first and second uprights. The frame interconnections may incorporate pivotal connections.

Typically, the panel diaphragm is secured to the first and second uprights and the upper and lower horizontals within the stud depth, i.e. within the depth of the shear panel frame members. The panel diaphragm is secured within the frame, preferably, inserting the peripheral edges of the panel diaphragm into an edge receiving member formed in, attached to or otherwise comprising in part the frame. In one preferred embodiment of the invention, the edge receiving member includes a groove or gap formed on the inner faces of the first and second uprights and the upper and lower horizontals. An edge receiving member may also include any frame configuration which results in a recess or channel, with or without a bottom, such as a gap formed between two sandwiched structural members, the resulting configuration sized and configured to accept a peripheral edge of a panel diaphragm. An edge receiving member may be formed as a result of the assembled configuration of sub-frame members, or in the alternative, it may be formed as a result of a cutting operation, such as sawing or routing, on one or more sub-frame members. In the preferred embodiment of the invention, the edge receiving members are formed in the first and second uprights by sawing or routing a groove on the inner faces of each of the first and second uprights.

In one embodiment of the invention, the shear panel assembly may include a center or intermittent upright connected to the upper and lower horizontals. The intermittent upright includes an edge receiving member formed on both side faces for engagement with a side peripheral edge of the panel diaphragm.

Placing the shear panel diaphragm within the inner periphery of the shear panel frame results in a shear panel assembly that has the advantage of not decreasing the out-of-plane stud depth. Additionally, a symmetric placement of the panel diaphragm within the depth of the frame promotes ductility and consistency of performance under load. Prying forces are reduced and secondary stresses that may be associated with asymmetrical configurations, such as in those situations wherein sheeting is nailed to the exterior surface of a stud wall, are minimized.

The combination of an edge receiving member located on the first and second uprights along a centerline of the inner faces of the first and second uprights and the panel diaphragm secured to the first and second uprights within an edge receiving member by cross nailing may improve shear panel performance. When a lateral force is applied to the shear panel, the first and second uprights are alternately placed in compression and tension. Forces are transferred through the panel diaphragm through the cross nailed edges to the first and second uprights. Cross nailing the side peripheral edges at the centerline of the first and second uprights within a groove results in improved strength at nailed connections and a reduced tendency to pull through, a condition wherein the head of the nail pulls through a secured component. The centerline location and attachment of the panel diaphragm to the first and second uprights results in an ability to use common outside or nominal dimensions for the frame members. This configuration results in optimal performance for the structural member and an increased moment of inertia compared to designs employing frame members having reduced dimensions. In addition, the centerline location and attachment of the panel diaphragm to the first and second uprights results in reduced probability of failure due to out-of-plane buckling forces.

The shear panel assembly may incorporate pivotal interconnections between the uprights and upper and lower horizontal frame members. Even shear panel assemblies that incorporate face-mounted shear panel diaphragms exhibit advantageous properties when they also incorporate pivotal connections. Such shear panel assemblies resist brittle failure, as even when the conventional fasteners securing the shear panel frame and shear panel diaphragm are stressed to failure, such shear panel assemblies retain ductility, and tend to flex in response to lateral stress, rather than fail catastrophically.

Shear panel assemblies that include symmetric placement of the panel diaphragm with the inner periphery of the shear panel frame, as well as pivotally interconnected frame members, exhibit substantially increased resistance to lateral stress and angular displacement without catastrophic failure.

The pair of upright frame members and the upper and lower horizontals may be formed of solid or engineered wood products. "Engineered wood products" as used herein refers generally to wood products formed of wood fibers of various configurations, bonded by adhesives and cured or treated to form a dimensional member. Engineered wood products may include, but are not limited to, oriented strand board (OSB), oriented strand lumber (OSL), laminated strand lumber (LSL), laminated veneer lumber (LVL), glued laminated timber (Glu-Lam), and parallel strand lumber (PSL). Advantages found in the use of engineered wood products include dimensional stability, uniformity of material and a greater predictability and repeatability of performance. For example, a laminated strand lumber (LSL) sold by TrusJoist® under the trademark TimberStrand® may be employed for the frame components. This material selection results in a significant advantage particularly to the extent that members formed of laminated strand material are essentially free of growth irregularities or structural deformation associated with twisting and the like. Additionally, the selection of LSL permits relatively higher nailing density patterns or clusters in critical areas, for instance along the panel diaphragm edges and the panel diaphragm centerline top edge. The panel diaphragm is formed, preferably, from oriented strand board (OSB) or other suitable sheet material.

The shear panel assembly typically includes a shear panel hold-down. The hold-down includes a base having at least one upright frame member engagement tab attached and extending from the base for attachment to an upright frame member. The base is typically configured to be attached to a lower horizontal frame member.

In one embodiment, the upright frame member engagement tab is attached to the base along a line substantially bisecting the width of the base and lying on a plane parallel to the plane of the shear panel. This embodiment of the shear panel hold-down allows attachment to an upright frame member along a vertical line in the plane of the panel diaphragm. In another embodiment, the hold-down includes two upright engagement tabs spaced appropriately to either accommodate an upright frame member between the tabs, or to fit into slots cut into the upright frame member. The upright frame member engagement tab may be formed of weldable steels or other alloys or in the alternative may be cast from iron or other alloys.

The base of the hold-down may be a tubular base that is formed of a section of standard dimensional steel tubing having a rectangular or square cross-section. In the alternative, the base may be cast from iron or other alloys. Instead of being formed from steel tubing, the base may be substantially U-shaped in cross-section.

In one embodiment, the upright frame member engagement tab is pivotally attached to the base so as to permit angular movement between the tubular base and an attached upright frame member to which the engagement tab is attached.

Figure 2:
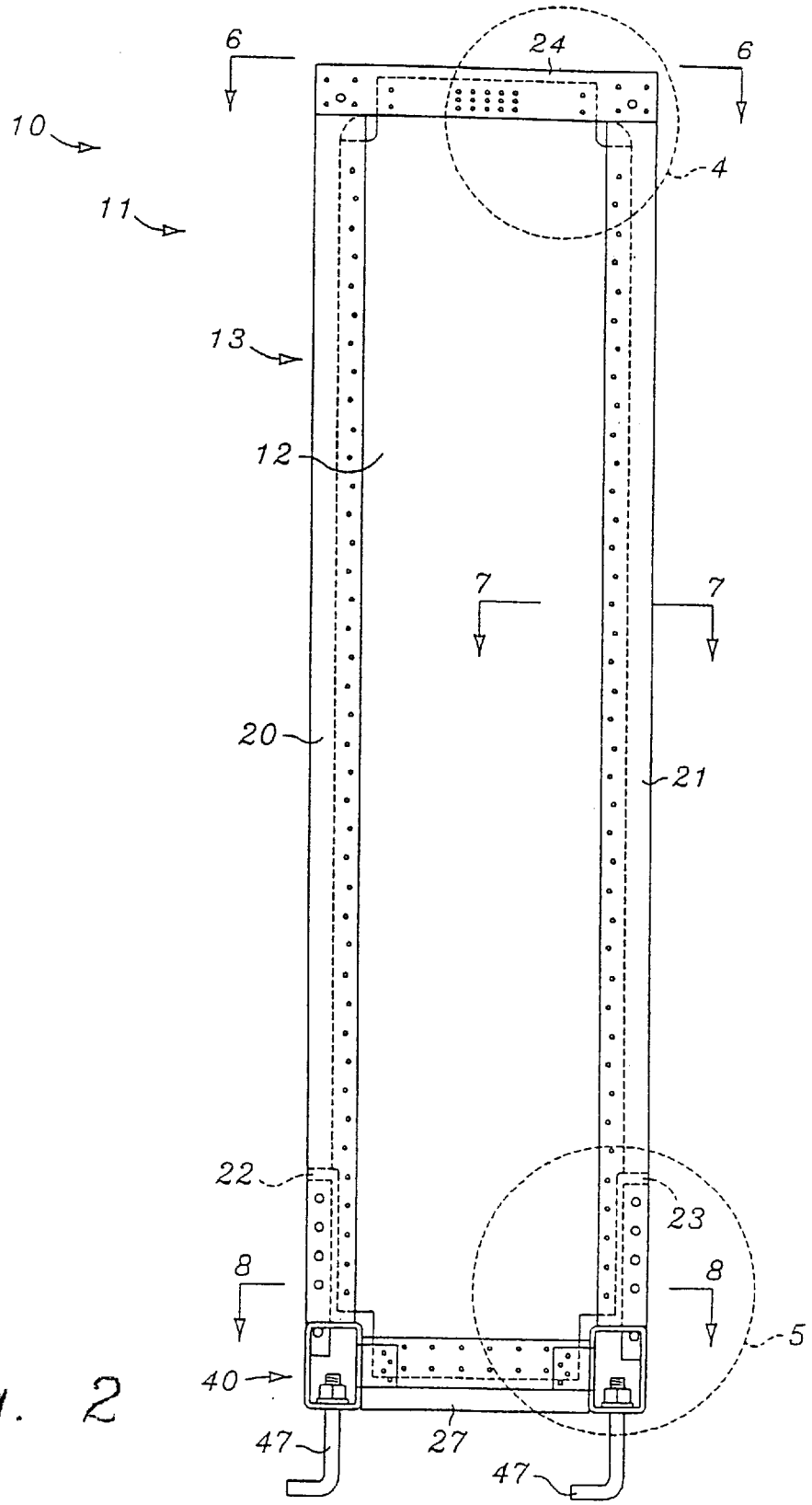
FIG. 2 is a representative assembled front view of a shear panel assembly according to the present invention.
Figure 3:
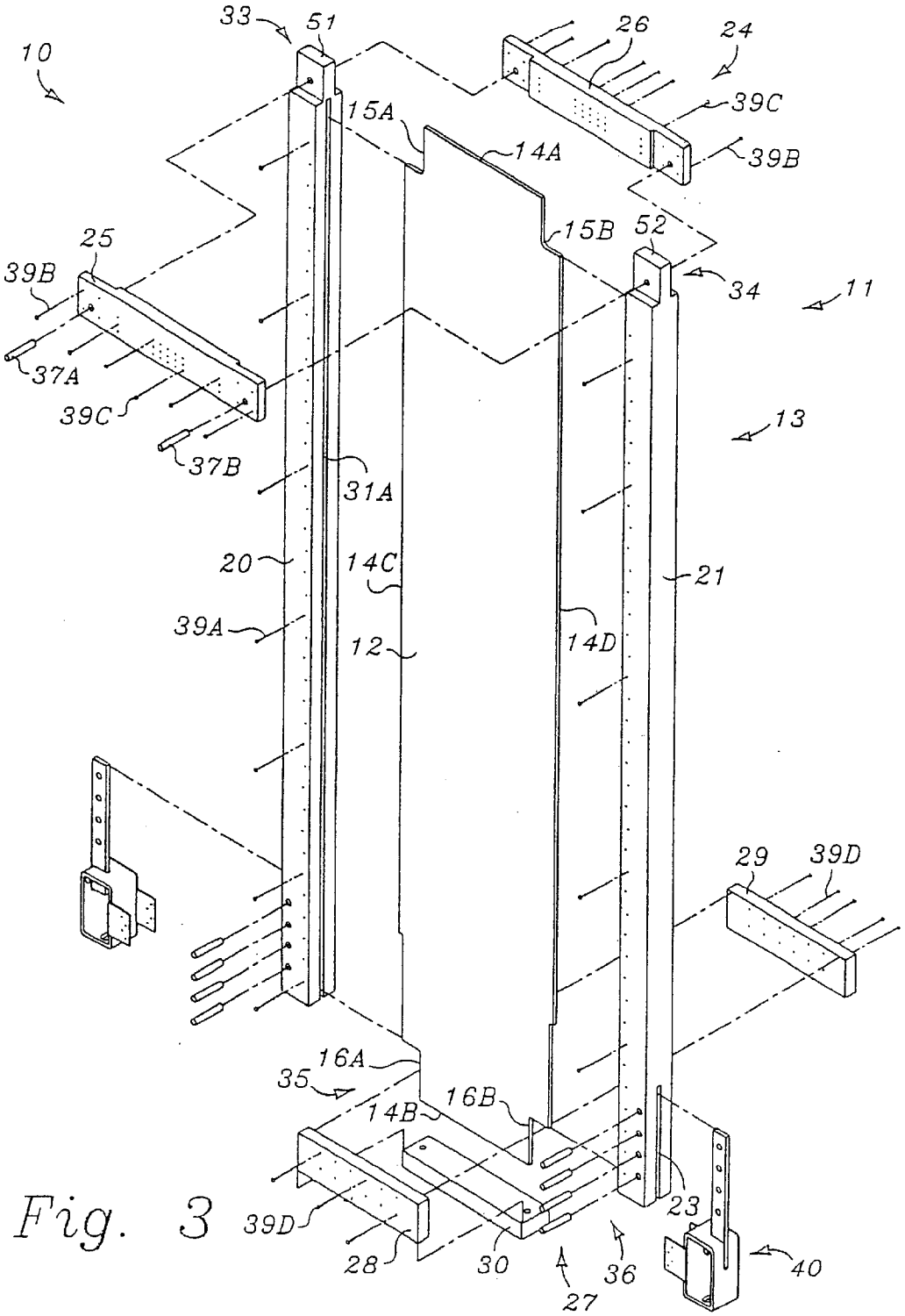
FIG. 3 is a representative exploded perspective view of a shear panel assembly according to the present invention.

Referring now to FIGS. 1 through 3, shear panel assembly 10 includes shear panel 11 and hold-down 40. Shear panel 11 includes panel diaphragm 12 that is secured within frame 13. FIG. 1 shows shear panel 11 installed at a corner of framed wall section W employing anchor bolts 47 cast in foundation F and threadedly engaging hold-down 40.

As shown in FIGS. 2 and 3, shear panel assembly 10 includes shear panel 11 and hold-down 40 including anchor bolt 47. Shear panel 11 includes panel diaphragm 12 that is secured within frame 13. Frame 13 includes first upright 20, second upright 21 and upper horizontal frame member 24 and lower horizontal frame member 27 interconnecting first upright 20 and second upright 21.

Referring to FIG. 3, frame 13 is configured having an edge receiving member formed on the inner periphery of frame 13. More particularly, first upright 20 and second upright 21 are formed having groove 31A, shown in FIG. 3, and groove 31 B, shown in FIG. 6. In addition, the structure resulting from the assembly of first upper horizontal element 25 and second upper horizontal element 26 and first lower horizontal element 28, second lower horizontal element 29 provides an edge receiving member in the form of a gap between these parts as further described below.

Figure 6:
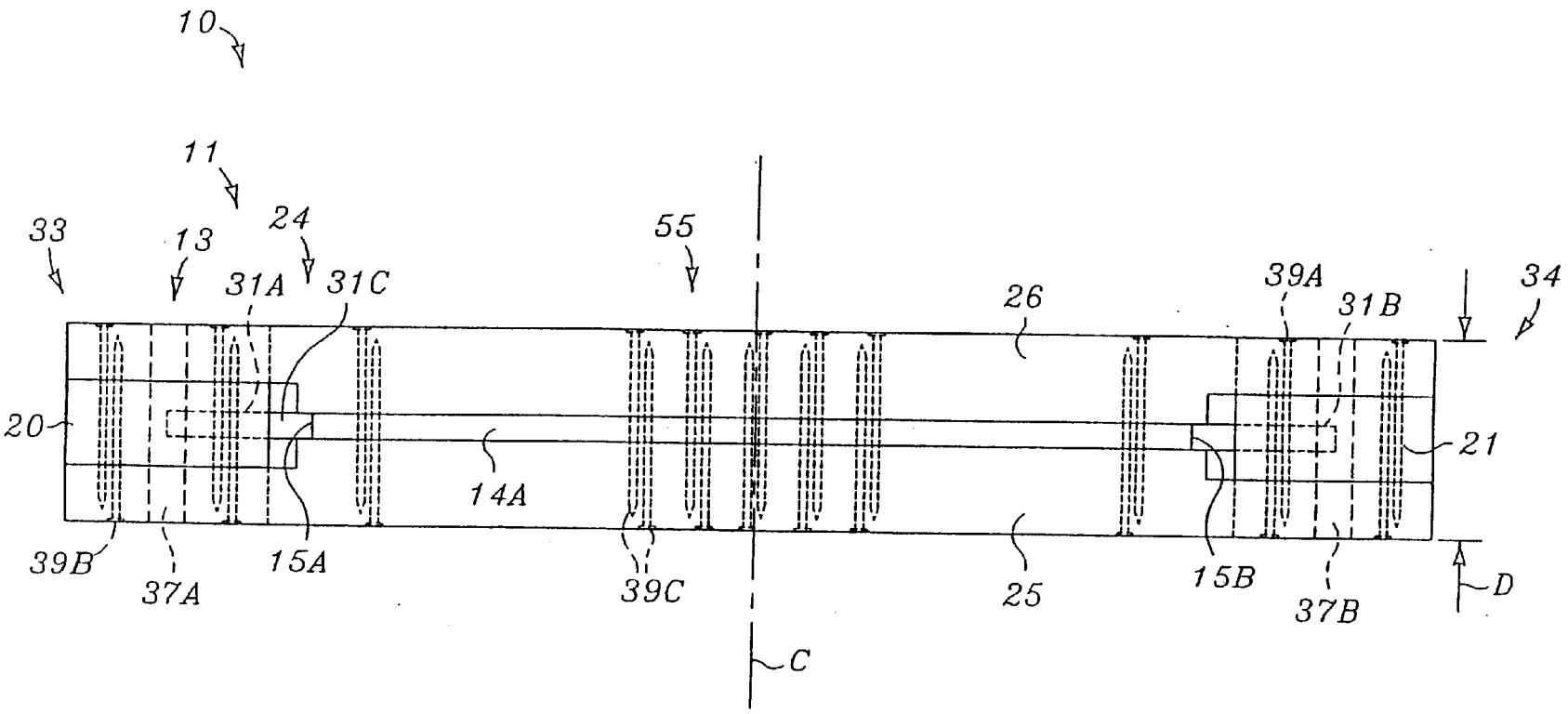
FIG. 6 is a representative top sectional view of a shear panel assembly according to the present invention.

Upper horizontal 24 as shown comprises a composite construction having first upper horizontal element 25 and second upper horizontal element 26. In the embodiment of the invention shown, first upright 20 and second upright 21 are formed having milled upper ends forming tongues 51 and 52. Similarly, first upper horizontal element 25 and second upper horizontal element 26 are formed having milled ends such that first upright 20, second upright 21, first upper horizontal element 25 and second upper horizontal element 26 may be joined employing a lap joint. As seen in FIG. 6, upon assembly, first upper horizontal element 25 and second upper horizontal element 26 provide an edge receiving member, groove 31C along an inner face of upper horizontal 24 between first upper horizontal element 25 and second upper horizontal element 26.

Lower horizontal 27 also includes a composite construction having first lower horizontal element 28, second lower horizontal element 29 and sill plate 30. First lower horizontal element 28 and second lower horizontal element 29 are connected to sill plate 30 in such a manner that the resulting assembly provides an edge receiving member, groove 31 D, (shown in FIG. 8), along an inner face of lower horizontal 27 between first lower horizontal element 28, second lower horizontal element 29 upon assembly.

Panel diaphragm 12 includes a continuous peripheral edge shown as top peripheral edge 14A, bottom peripheral edge 14B, first side peripheral edge 14C and second side peripheral edge 14D. Panel diaphragm 12 also include includes first upper cope 15A, second upper cope 15B, first lower cope 16A and second lower cope 16B. As shown in FIGS. 2 and 3 panel diaphragm 12 is secured within frame 13 employing several distinct nailing patterns. Side peripheral nails 39A secure first side peripheral edge 14C and second side peripheral edge 14D in groove 31A, shown in FIG. 3, and groove 31B, shown in FIG. 6 respectively. Upper nails 39C secure top peripheral edge 14A between first upper horizontal element 25 and second upper horizontal element 26. Upper nails 39C are located in a concentration about a centerline of panel diaphragm 12 that promotes ductility in the assembly as further discussed below. Lower nails 39D secure bottom peripheral edge 14B between first lower horizontal element 28 and second lower horizontal element 29. Lower nails 39D are dispersed broadly across the width of bottom peripheral edge 14B in a manner that promotes rigidity in the connection of bottom peripheral edge 14B between first lower horizontal element 28 and second lower horizontal element 29. In each case, side peripheral nails 39A, upper corner nails 39B, upper nails 39C and lower nails 39D are all driven in a cross nailing pattern.

FIGS. 2 and 3 show first upright 20 having first upright engagement tab slot 22 and second upright engagement tab slot 23, (shown in FIG. 3).

Figure 4:
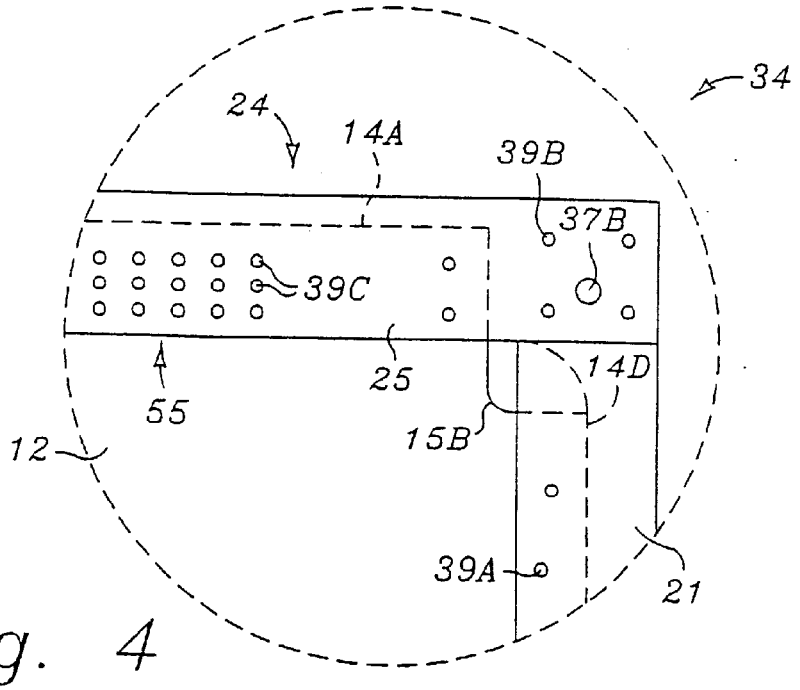
FIG. 4 is a representative front upper corner detail of a shear panel assembly according to the present invention.

FIG. 4 is a front view upper corner detail of a shear panel assembly 10 showing second upper corner joint 34 formed where pin 37B hingedly interconnects upper horizontal 24 and second upright 21. Panel diaphragm 12 is shown with top peripheral edge 14A fastened to upper horizontal 24 with upper nails 39C. Second cope 1 5B promotes ductility of shear panel assembly 10 by permitting panel diaphragm 12 to pivot about centerline nail cluster 55 with greater displacement.

Figure 5:
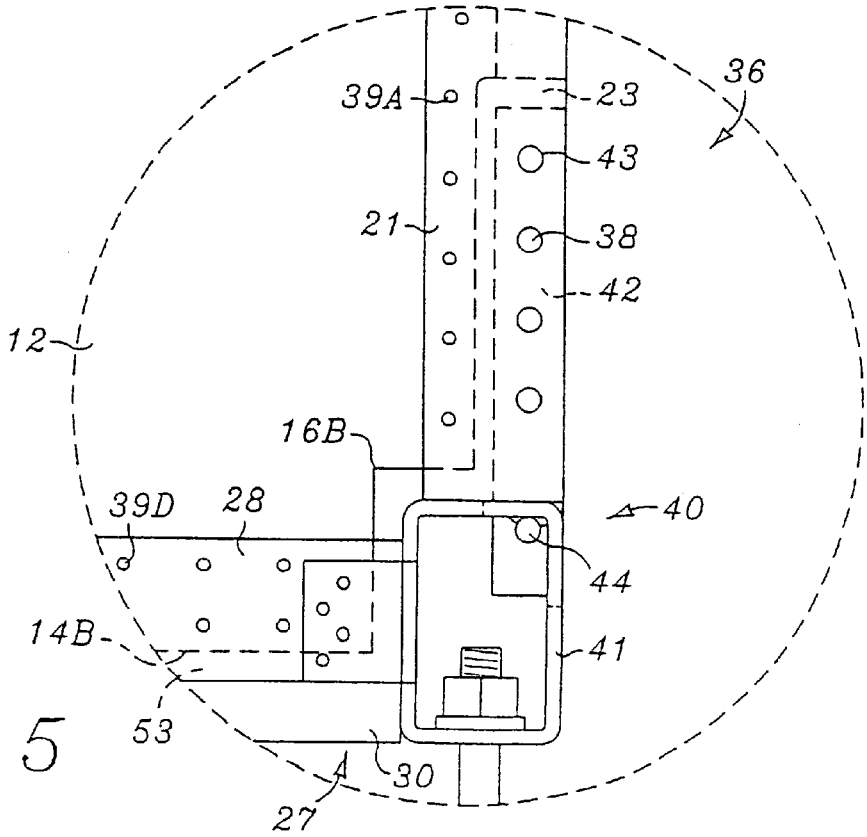
FIG. 5 is a representative front lower corner detail of a shear panel assembly according to the present invention.

FIG. 5 is a front view lower corner detail of a shear panel assembly 10 showing second lower corner joint 36 formed where lower horizontal 27 and second upright 21 are joined by hold-down 40. Panel diaphragm 12 is shown with lower peripheral edge 14B fastened to lower horizontal 27 with lower nails 39D with space 53 observed between lower peripheral edge 14B and sill plate 30. First lower horizontal element 28 is attached to the upper face of sill plate 30. Second upright 21 is pivotally connected to hold-down 40. As shown, upright frame member engagement tab 42 is pivotally connected to tubular base 41 by pin 44. Upright frame member engagement tab 42 inserts into second upright engagement tab slot 23 and is pinned with lower corner connectors 38 which extend through a cooperating aperture 43. Second lower cope 16B, space 53 and the pivotable connection of the upright frame members to their respective hold-downs, all promote ductility of shear panel assembly 10 by permitting panel diaphragm 12 to pivot with greater displacement.

FIG. 6 is a top view sectional of a shear panel assembly 10 showing first upper corner joint 33 and second upper corner joint 34 formed where pins 37A and 37B hingedly interconnect upper horizontal 24 to first upright 20 and second upright 21. First upright 20 and second upright 21 are formed having groove 31A and groove 31B respectively. Panel diaphragm 12 is shown with top peripheral edge 14A fastened to first upper horizontal element 25 and second horizontal element 26 upper nails 39C. Centerline nail cluster 55 is shown extending laterally from centerline C of shear panel assembly 10. Centerline nail cluster 55 exhibits a cross nailing pattern. Copes 15A and 15B permit panel diaphragm 12 to pivot about centerline nail cluster 55 with greater displacement. The configuration of shear panel 11 as shown in FIG. 6 results in an assembly having a depth D. As shown, panel diaphragm 12 is secured symmetrically within a depth D of shear panel 11.

Figure 7:
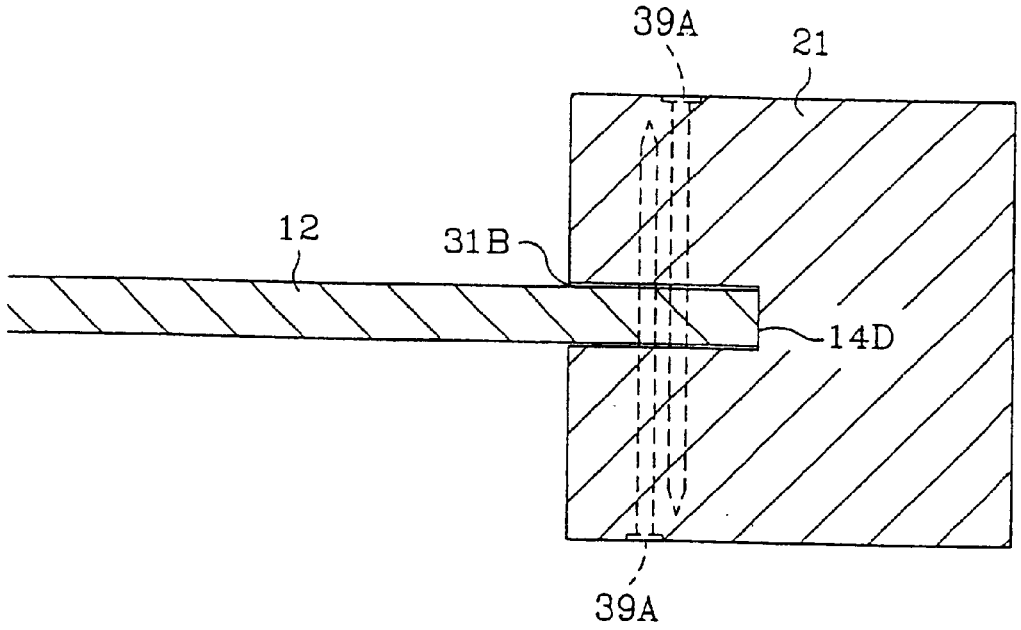
FIG. 7 is a representative vertical sectional view of a shear panel assembly according to the present invention.

FIG. 7 is a vertical sectional detail showing second side peripheral edge 14D of panel diaphragm 12 inserted within groove 31B of second upright 21. Second side peripheral edge 14D of panel diaphragm 12 fits snugly within the root of groove 31B. Nails 39 are depicted in a cross nailing pattern providing a double shear connection.

Figure 8:
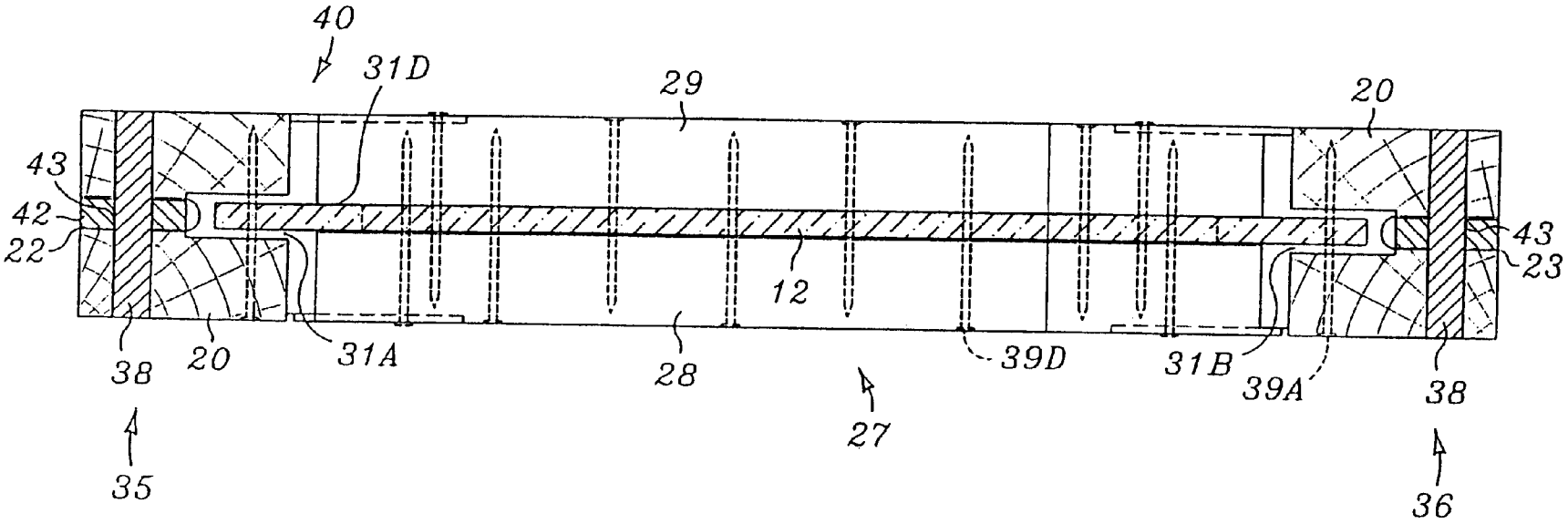
FIG. 8 is a representative vertical sectional view of a shear panel assembly according to the present invention.

FIG. 8 is a top view sectional of a shear panel assembly 10 showing first lower corner joint 35 and the second lower corner joint 36. First lower horizontal element 28 and second lower horizontal element 29 are connected to sill plate 30, (shown in FIG. 3). The relative configurations of first lower horizontal element 28 20 and second lower horizontal element 29 provide an edge receiving aperture or gap along an inner face of lower horizontal 27 into which bottom peripheral edge 14B fits. Bottom peripheral edge 14B is sandwiched between first lower horizontal element 28 and second lower horizontal element 29 and cross nailed with lower nails 39D. Upright frame member engagement tab 42 of hold-down 40 is shown inserted within first upright engagement tab slot 22 and lower corner connector 38 is inserted through connector aperture 43. An upright frame member engagement tab is shown similarly inserted within second upright engagement tab slot 23 with a lower corner connector 38 inserted through a corresponding connector aperture 43.

Employing cross nailing as shown in FIG. 8 and throughout, particularly at FIGS. 3, 6 and 7, results in a double shear connection with substantially improved shear strength along the nailed joints.

Figure 9:
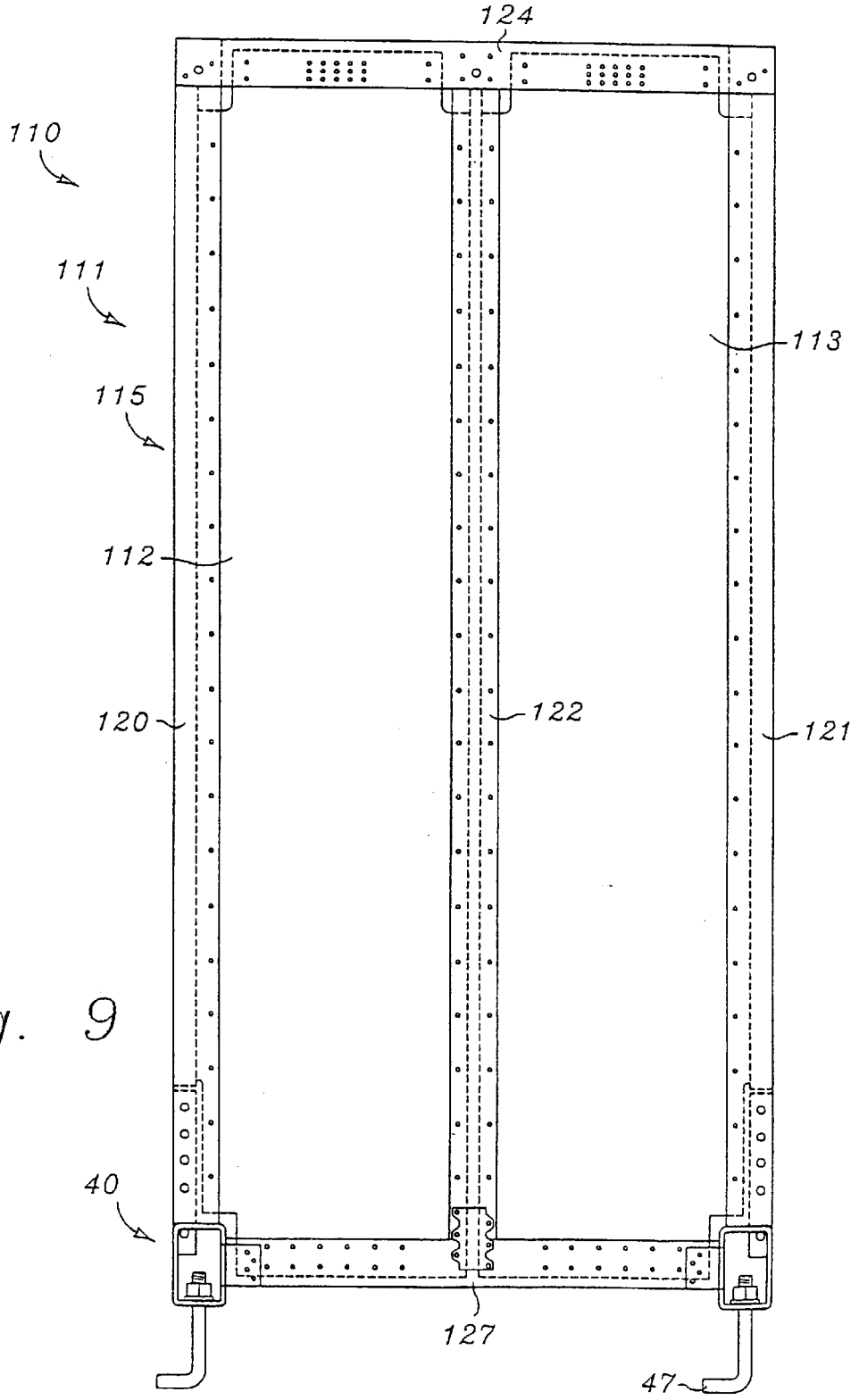
FIG. 9 is a representative assembled front view of a shear panel assembly including two panel diaphragms and an intermittent upright according to the present invention.
Figure 13:
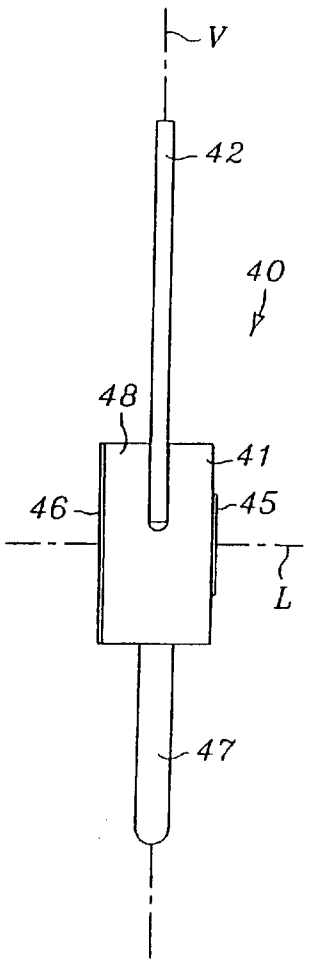
FIG. 13 is a second side view of a shear panel hold-down according to the present invention.
Figure 12:
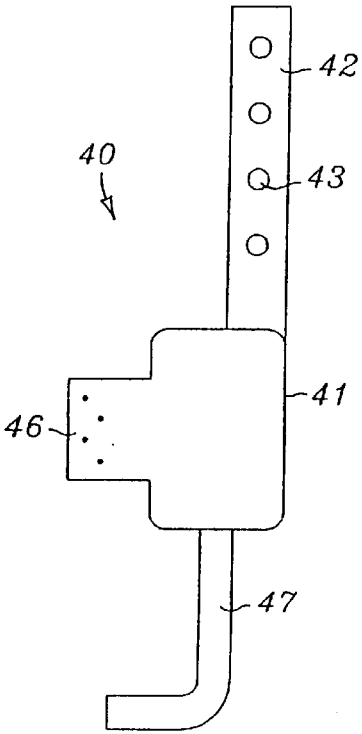
FIG. 12 is a rear view of a shear panel hold-down according to the present invention.
Figure 11:
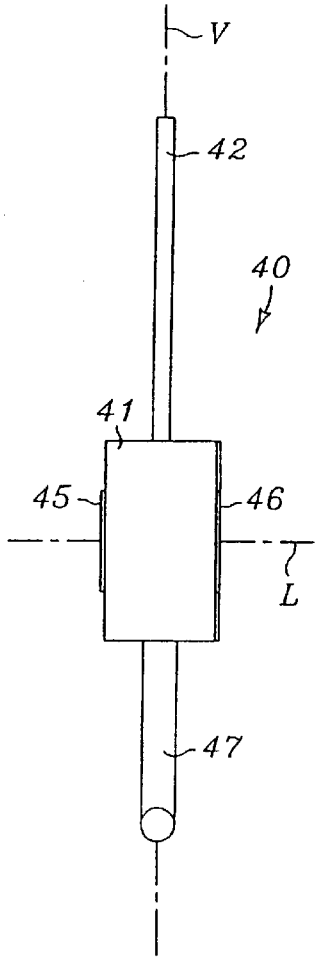
FIG. 11 is a first side view of a shear panel hold-down according to the present invention.
Figure 10:
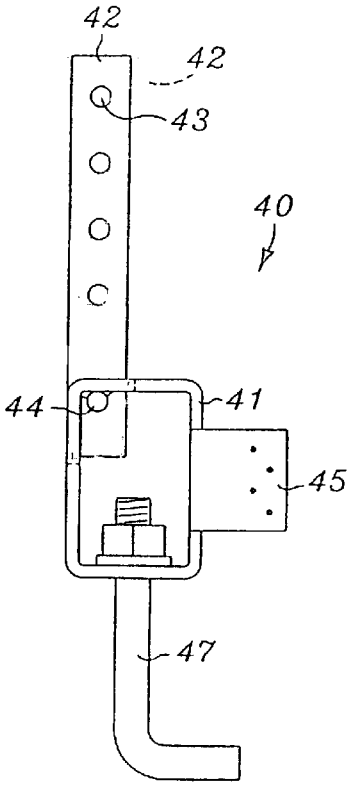
FIG. 10 is a front view of a shear panel hold-down according to the present invention.

FIGS. 9 depicts an alternate embodiment of the invention shown generally as shear panel assembly 110 which may be employed in situations requiring a wider shear panel installation. Shear panel assembly 110 includes shear panel 111 and hold-down 40 including anchor bolt 47. Shear panel 111 includes panel diaphragms 112 and 113 that are secured within frame 115. Frame 115 includes first upright 120, second upright 121 and intermittent upright 122. First upright 120, second upright 121 and intermittent upright 122 hingedly interconnect with upper horizontal 124 and lower horizontal 127. Intermittent upright 122 is formed having a groove on each of the two opposing side faces, one groove being configured to receive a peripheral edge of panel diaphragm 112 and the opposing groove being configured to receive a peripheral edge of panel diaphragm 113.

A particular embodiment of the shear panel hold-down of the invention is shown in FIGS. 10-13. The hold-down incorporates a tubular base 41 to which upright frame member engagement tab 42 is attached. Upright frame member engagement tab 42 extends from the tubular base 41 along a line V substantially bisecting the width of tubular base 41. Upright frame member engagement tab 42 lies on a plane perpendicular to a longitudinal axis L of the tubular base. Upright frame member engagement tab 42 extends through side wall 48 of tubular base 41 and is pivotally attached to tubular base 41 by pin 44 that is attached also to tubular base 41. Upright frame member engagement tab 42 includes a plurality of connector apertures 43. Hold-down 40 also includes first ear 45 and second ear 46 for attachment to lower horizontal 27. Second ear 46, as shown attached across the open end of tubular base 41, serves to stiffen tubular base 41. Anchor bolt 47 is provided to secure hold-down 40 to a foundation as shown in FIG. 1.

Figure 14:
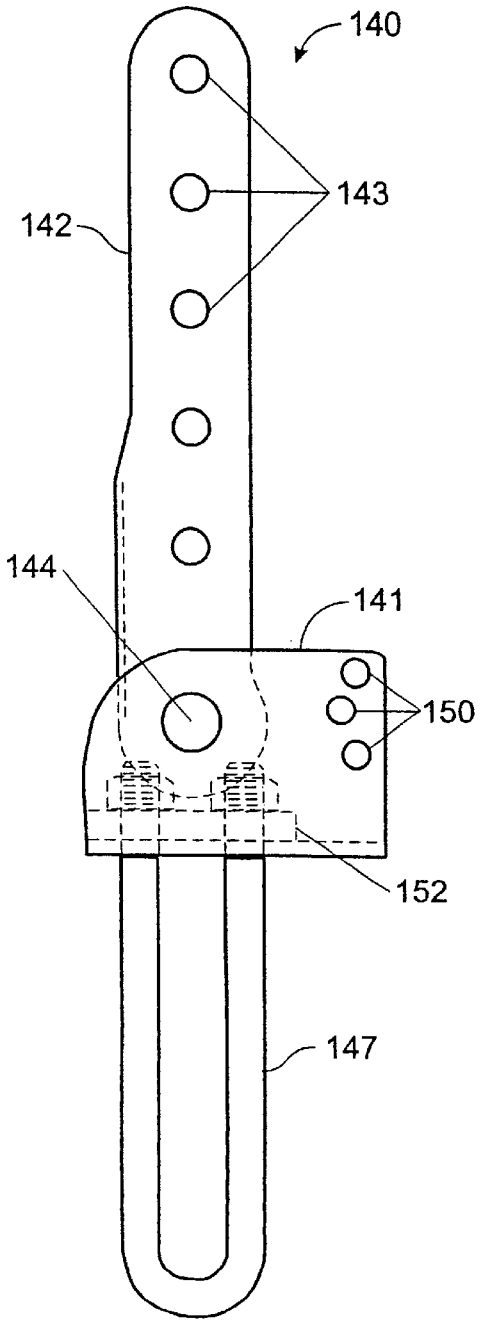
FIG. 14 is a front view of a shear panel hold-down according to the present invention.
Figure 15:
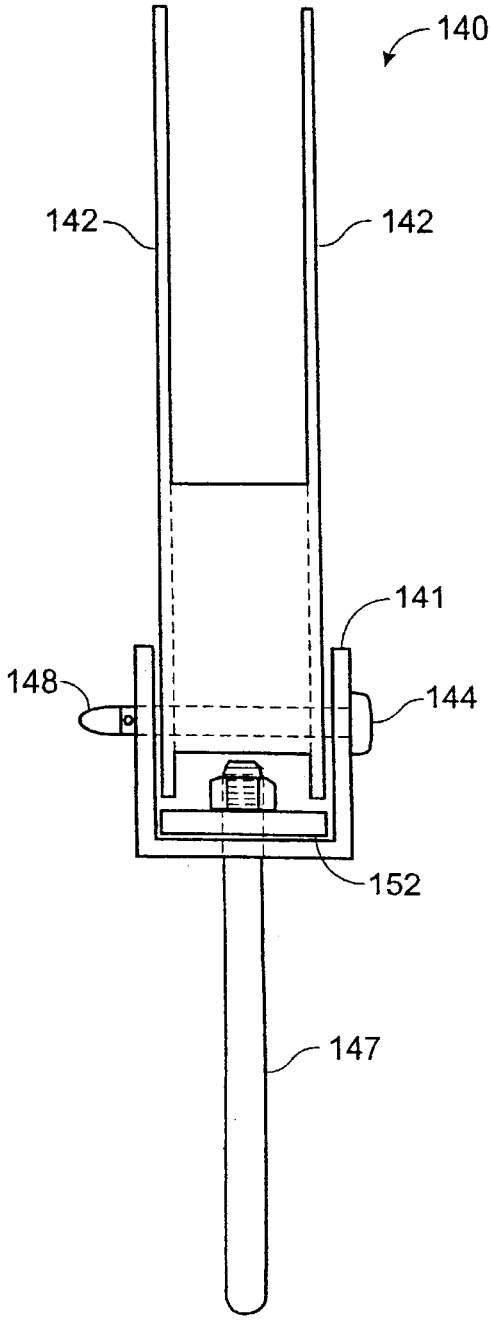
FIG. 15 is a side view of a shear panel hold-down according to the present invention.

A preferred embodiment of the shear panel hold-down of the invention is shown in FIGS. 14–15. Hold-down 140 incorporates a base bracket 141 to which upright frame member engagement tabs 142 are attached. The upright frame member engagement tabs are pivotally connected to base bracket 141 by a clevis pin 144. Clevis pin 144 provides a pivotable connection between base bracket 141 and upright frame member engagement tabs 142, and therefore the upright frame member of the shear panel assembly. As discussed above, the pivotable connection in the shear panel assembly of the invention provide resiliency in response to applied stresses. However, in order to confer the desired degree of stiffness in the assembled shear panel, the clevis pin should snugly fit into the base bracket and upright frame member. Installation of the clevis pin may therefore be facilitated by incorporating a rounded or tapered tip 148 on the clevis pin, as shown in FIG. 15. The tip or nose is typically prepared from a polymeric material, and is preferably nylon that is 20% glass filled.

The upright engagement tabs 142 include a plurality of apertures 143 for attaching the upright frame member using a plurality of fasteners. Similarly, the base bracket includes a plurality of apertures 150 for attaching a lower horizontal frame member using a plurality of fasteners. Base bracket 141 further includes slots for adjustably securing the hold-down to an anchor bolt 147. In one aspect of the invention, the base bracket includes one or more apertures that serve as inspection ports for examining the connection to the anchor bolt.

Although a variety of anchor bolts and fasteners are suitable for securing a hold-down to a foundation, as shown for the hold-down of FIGS. 14–15 anchor bolt 147 is a U-shaped anchor bolt having two threaded ends that are each engaged by a fastener that is a complementarily threaded nut. The hold-down of FIGS. 14–15 further includes a washer plate 152 interposed between the base bracket and the anchor bolt fasteners. The washer plate provides the shear panel assembly with improved resistance to 'twisting' or 'prying' forces.

Referring to FIG. 3, to assemble, first side peripheral edge 14C and second side peripheral edge 14D of panel diaphragm 12 are inserted within grooves 31A and 31 B, as seen in FIG. 6, of first upright 20 and second upright 21 respectively. Each of the first upper corner joint 33 and the second upper corner joint 34 are assembled by fitting tongue 51 of first upright 20 and tongue 52 of second upright 21 with the milled ends of first upper horizontal element 25 and second upper horizontal element 26 and pinning the joints using pins 37A and 37B. Upon assembly, the relative configurations of first upper horizontal element 25 and second upper horizontal element 26 provide an edge receiving aperture or gap along an inner face of upper horizontal 24 into which top peripheral edge 14A fits.

First lower horizontal element 28 and second lower horizontal element 29 are connected to sill plate 30. Upon assembly, the relative configurations of first lower horizontal element 28 and second lower horizontal element 29 provide an edge receiving aperture or gap along an inner face of lower horizontal 27 into which bottom peripheral edge 14B fits. Each of the first lower corner joint 35 and the second lower corner joint 36 are assembled by inserting an upright frame member engagement tab 42 of a hold-down 40 into first upright engagement tab slot 22 or second upright engagement tab slot 23. First ear 45 and second ear 46 extend over the outer faces of lower horizontal 27. Lower corner connectors 38 are inserted at first lower corner joint 35 and second lower corner joint 36 respectively extending through a corresponding connector aperture 43.

In the preferred embodiment of the invention, nailing of the top peripheral edge 14A of panel diaphragm 12 to first upper horizontal element 25 and second upper horizontal element 26 is concentrated towards the centerline of panel diaphragm 12. Centerline nail cluster 55 of upper nails 39C provides initial stiffness and resistance against a shear force applied to shear panel assembly 10 as centerline nail cluster 55 creates moment connections at small displacements. As greater displacement of shear panel assembly 10 occurs, upper corner nails 39B yield gradually and pins 37A and 37B act like a hinge promoting ductility of shear panel assembly 10 while maintaining structural integrity. In one preferred embodiment of the invention, first upright 20 and second upright 21 each pivotally attach at a hold-down 40 as previously described and shown in FIG. 5.

Installation of a preassembled shear panel typically requires the placement of multiple anchoring devices, typically anchor bolts, in a poured foundation. Placement of the anchor bolts is typically facilitated by the use of an installation jig, typically supplied with the shear panel, that holds the anchor bolts in a predetermined and appropriate spacing and orientation while the foundation is being poured. After the foundation is set, the installation jig is removed and the shear panel assembly is installed.

Figure 16:
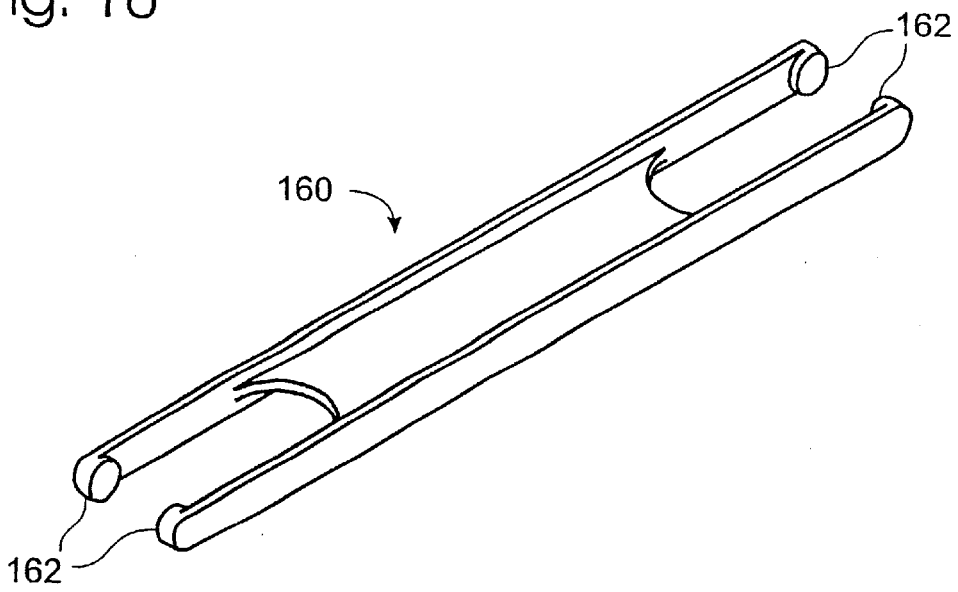
FIG. 16 is an isometric view of an installation jig according to the present invention.

A typical installation jig 160 shown in FIG. 16. During use, projections 162 are inserted into the clevis pin holes of the base brackets to provide appropriate spacing and orientation between the base brackets. In one aspect of the invention, the installation jig is composed of a polymeric material, such as polypropylene or a copolymer of polypropylene. Installation jigs of the type shown in FIG. 16 facilitate the installation of base brackets for shear panels that have a predefined spacing.

Figure 17:
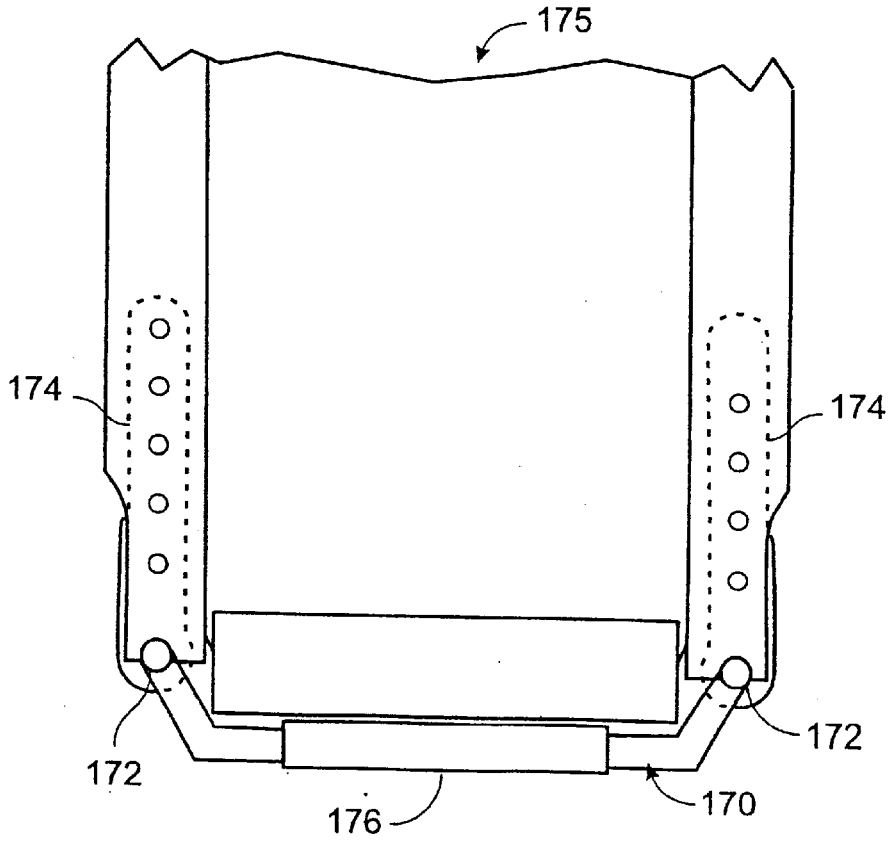
FIG. 17 is a partial front view of a shear panel assembly that includes a telescoping installation jig according to the present invention.

Variations may exist between individual shear panel assemblies due to manufacturing differences, inconsistent or unpredictable swelling of wood products, or other factors, with the result that a single premanufactured installation jig is unable to accurately place the anchor bolts for every shear panel. In this case, an adjustable, or telescoping, installation jig is used to accurately place the anchor bolts in the foundation. FIG. 17 shows a telescoping installation jig 170 attached to a preassembled shear panel 175. Jug 170 is first adjusted to match the spacing between clevis pin holes 172 of the upright engagement tabs 174 of the shear panel assembly, my manipulating a telescoping connection 176. As shown in FIG. 17, jig 170 exhibits a shallow U-shaped profile. This nonlinear conformation is necessary in order to simultaneously attach to both clevis pin holes 172 on the preassembled shear panel. After jig 170 is set at the appropriate length, telescoping portion 176 is fixed in place by tightening one or more set screws or some other appropriate locking mechanism. After the length of the jig is fixed, the jig is removed from shear panel assembly 175, the base brackets and anchor bolts are mounted to the installation jig, and the anchor bolts are installed in the foundation. The use of telescoping installation jig 170 permits the anchor bolts to be installed to fit a particular shear panel assembly with precision.

Although the present invention has been shown and described with reference to the foregoing operational principles and preferred embodiments, it will be apparent to those skilled in the art that various changes in form and detail may be made without departing from the spirit and scope of the invention. The present invention is intended to embrace all such alternatives, modifications and variances that fall within the scope of the appended claims.

What is claimed is:

1. A shear panel comprising a frame and a panel diaphragm, where the frame comprises:

an upper horizontal frame member;

a first upright pivotally interconnecting a first end of the upper horizontal frame member;

a second upright pivotally interconnecting a second end of the upper horizontal frame member;

a lower horizontal frame member pivotally interconnecting a lower end of the first upright and a lower end of the second upright; and where the panel diaphragm is connected to the frame, wherein the frame further comprises an engineered wood product.

2. The shear panel of claim 1, where the panel diaphragm is connected to the frame at an inner peripheral face of the frame.

3. The shear panel of claim 1, where the panel diaphragm further comprises a peripheral edge, the frame further comprises a panel diaphragm edge receiving member formed on an inner peripheral face of the frame within a depth of the frame, and the panel diaphragm edge is connected to the panel diaphragm edge receiving member.

4. The shear panel of claim 3 wherein the panel diaphragm edge receiving member comprises:

a groove formed on an inner face of the first upright;

a groove formed on an inner face of the second upright;

a gap formed on an inner face of the upper horizontal frame member; and a gap formed on an inner face of the lower horizontal frame member.

5. The shear panel of claim 1, where the first end of the lower horizontal frame member and the lower end of the first upright are pivotally interconnected by a first hold-down; and the second end of the lower horizontal frame member and the lower end of the second upright are pivotally interconnected by a second hold-down.

6. The shear panel of claim 5, where the first hold-down comprises a base and a pivotable upright engagement tab attached to and extending from the base along a line substantially bisecting a width of the base, and the engagement tab is connected to the first upright; and the second hold-down comprises a base and a pivotable upright engagement tab attached to and extending from the base along a line substantially bisecting a width of the base, and the engagement tab is connected to the second upright.

7. The shear panel of claim 6, where the first hold-down further comprises at least one ear attached to and extending from the base that is connected to a first end of the lower horizontal frame member, and the second hold-down further comprises at least one ear attached to and extending from the base that is connected to a second end of the lower horizontal frame member, such that the horizontal frame member is interconnected with and disposed between the first and second hold-downs.

* * * * *